US007140709B2

(12) United States Patent
Couwenhoven et al.

(10) Patent No.: US 7,140,709 B2
(45) Date of Patent: Nov. 28, 2006

(54) USING INKJET PRINTER TO APPLY PROTECTIVE INK

(75) Inventors: Douglas W. Couwenhoven, Fairport, NY (US); Christopher Rueby, North Chili, NY (US); David S. Uerz, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 123 days.

(21) Appl. No.: 10/785,835

(22) Filed: Feb. 24, 2004

(65) Prior Publication Data

US 2005/0185008 A1 Aug. 25, 2005

(51) Int. Cl.
*B41J 2/205* (2006.01)

(52) U.S. Cl. ..... 347/15; 347/14; 347/21; 347/6; 347/100

(58) Field of Classification Search ..... 347/6, 347/102, 45

See application file for complete search history.

(56) References Cited

U.S. PATENT DOCUMENTS 3,977,007 A * 8/1976 Berry et al. ..... 347/15
6,412,935 B1 7/2002 Doumaux
6,435,657 B1 * 8/2002 Couwenhoven et al. ..... 347/43
6,443,568 B1 9/2002 Askeland et al.
6,464,349 B1 * 10/2002 Moriyama et al. ..... 347/101
6,503,978 B1 1/2003 Tsao et al.

* cited by examiner

*Primary Examiner*—Vip Patel
*Assistant Examiner*—Brian J. Goldberg
(74) *Attorney, Agent, or Firm*—Raymond L. Owens

(57) ABSTRACT

A method of determining and applying a protective ink amount to be printed in addition to a plurality of colored ink amounts to make colored pixels in an image including determining a first protective ink amount responsive to the colored ink amounts, determining multitoned colored ink amounts using a multitone processor responsive to the colored ink amounts, and determining a second protective ink amount responsive to the multitoned colored ink amounts. The method also includes determining the protective ink amount responsive to the first protective ink amount and the second protective ink amount to provide adequate durability for the image, and applying using an inkjet printer the colored ink amounts and the protective ink amount to make the colored image pixels.

12 Claims, 7 Drawing Sheets

USING INKJET PRINTER TO APPLY PROTECTIVE INK

CROSS REFERENCE TO RELATED APPLICATIONS

Reference is made to commonly assigned U.S. patent application Ser. No. 10/785,818 filed Feb. 24, 2004 by Douglas W. Couwenhoven, et al., entitled "Inkjet Printing Using Protective Ink", the disclosure of which is herein incorporated by reference.

FIELD OF THE INVENTION

This invention pertains to the field of digital imaging, and more particularly to a method for computing an amount of protective ink to be used in the process of printing a digital image.

BACKGROUND OF THE INVENTION

In the field of digital printing, a digital printer receives digital data from a computer and places colorant on a receiver to reproduce the image. A digital printer can use a variety of different technologies to transfer colorant to the page. Some common types of digital printers include inkjet, thermal dye transfer, thermal wax, electrophotographic, and silver halide printers.

Modern inkjet printers are capable of delivering excellent image quality, but suffer from poor durability with respect to environmental factors such as atmospheric gases and staining fluids. For example, naturally occurring ozone is known to cause fading in inkjet prints, which are exposed to the atmosphere. The degree of fading can become unacceptable in a relatively short time period, often only a few weeks of exposure to the air. Exposure to moisture and/or staining agents can be another source for unacceptable image quality artifacts in an inkjet print. Many inkjet prints will "run" or "bleed" (where the ink begins to run off the page) when exposed to water. When subjected to other fluids such as coffee or mustard, unacceptable stains can form on the surface of the inkjet print, often in the white portions of the page where ink has not been printed. Additionally, there are optical effects that can occur with inkjet prints, which result in a perceived image quality loss. In particular, the gloss difference at the boundary between the inked and non-inked areas of the image can be disturbing to a human observer. Yet another environmental factor that can cause image artifacts in an inkjet print is handling or abrasion. Rubbing an inkjet print with a finger can cause the ink to smear from a printed area into a non-printed area, resulting in poor image quality.

The above described image artifacts can occur in inkjet prints because the surface of an inkjet print is not "sealed" or protected from the environment. Several methods to address these undesirable image artifacts are known in the art. One technique known in the art is to laminate the print, but this is typically too time-consuming and costly. Another technique is to apply an additional, substantially clear ink that has protective properties to the image during or shortly after the printing process. For example, U.S. Pat. No. 6,412,935 to Doumaux discloses an inkjet printer in which a "fixer" ink is printed using a separate printhead, which is vertically offset from the colored ink printheads. This technique involves an extra print pass where the paper is not advanced, and the fixer fluid is printed over the image. Similar techniques are described in U.S. Pat. No. 6,503,978. U.S. Pat. No. 6,443,568 to Askeland, et al., describes a method of underprinting and overprinting a clear fixer fluid, and applying heat to provide for improved water fastness.

The above mentioned references teach the use of a protective fluid for improving print durability, but do not teach methods of controlling the laydown of the protective fluid in response to the amount of colored ink that will be printed. For example, the use of pigmented inks is known to provide for some increase in durability properties when compared with dye inks. The application of a full layer of protective fluid on top of an area printed with pigmented inks is likely unnecessary to achieve the desired durability, and is wasteful of ink. Also, indiscriminate application of protective fluid leads to a dramatic increase in the total amount of fluid deposited on the page, which is known to cause other negative image quality artifacts. See for example U.S. Pat. No. 6,435,657.

Additionally, when applying a protective ink to provide for improved durability, the best protection is achieved when the surface of the receiver is completely sealed from environmental factors. If the protective ink amount is computed before the image data is halftoned (as described in commonly assigned U.S. patent application Ser. No. 10/785,818 filed Feb. 24, 2004 by Douglas W. Couwenhoven, et al., entitled "Inkjet Printing Using Protective Ink", the disclosure of which is herein incorporated by reference), then complete coverage of the receiver can not be guaranteed, since the halftone process will result in patterns of dots of protective ink that do not necessarily fill in all of the "white holes" left by unprinted pixels.

Thus, there is a need for a method of computing a protective ink amount to be applied to an image to provide for improved durability, while minimizing the total amount of fluid deposited on the page, and ensuring complete coverage of the receiver with either protective or colored ink for maximum environmental durability.

SUMMARY OF THE INVENTION

It is an object of the present invention to provide a method for improving the quality of printed images by providing for improved durability of the image when exposed to environmental factors such as atmospheric gases, water, staining agents, or abrasion.

It is a further object of the present invention to provide for improved durability of printed images while minimizing the total amount of ink used.

Yet another object of the present invention is to provide for improved image quality by reducing optical effects such as differential gloss between inked and non-inked areas.

Still another object of the present invention is to provide for complete sealing of the receiver from environmental factors.

These objects are achieved by a method of determining and applying a protective ink amount to be printed in addition to a plurality of colored ink amounts to make colored pixels in an image, comprising:

a) determining a first protective ink amount responsive to the colored ink amounts;

b) determining multitoned colored ink amounts using a multitone processor responsive to the colored ink amounts;

c) determining a second protective ink amount responsive to the multitoned colored ink amounts;

d) determining the protective ink amount responsive to the first protective ink amount and the second protective ink amount to provide adequate durability for the image; and e) applying using an inkjet printer the colored ink amounts and the protective ink amount to make the colored image pixels.

ADVANTAGES

The present invention has an advantage over the prior art in that it provides for improved durability of inkjet prints to environmental factors such as atmospheric gases, water, staining agents, or abrasion, using a protective ink, while minimizing the amount of protective ink required to achieve satisfactory durability. This results in lower cost per print, or more prints per cartridge, for the end user, which is a significant advantage. The present invention also provides for complete sealing of the receiver from the environment, thereby maximizing durability. Another advantage of the present invention is that optical effects that can result in poor image quality, such as differential gloss, are minimized. A further advantage of the present invention is that it provides a way for applying a different amount of protective ink in response to the colored inks that are being printed, resulting in a more efficient use of the protective ink, with less waste.

DETAILED DESCRIPTION OF THE INVENTION

This invention describes a method for computing a protective ink amount to be printed in addition to a plurality of colored ink amounts to provide for improved image quality as set forth in the objects described above. The protective ink provides durability properties, but has no colorant and is substantially clear. The invention is presented hereinafter in the context of an inkjet printer. However, it should be recognized that this method is applicable to other printing technologies as well.

An input image is composed of a two dimensional (x,y) array of individual picture elements, or pixels, and can be represented as a function of two spatial coordinates, (x and y), and a color channel coordinate, c. Each unique combination of the spatial coordinates defines the location of a pixel within the image, and each pixel possesses a set of input code values representing input colorant amounts for a number of different inks indexed by the color channel coordinate, c. Each input code value representing the amount of ink in a color channel is generally represented by integer numbers on the range {0,255}. A typical set of inks for an inkjet printer includes cyan (C), magenta (M), yellow (Y), and black (K) inks, hereinafter referred to as CMYK inks.

Figure 1:
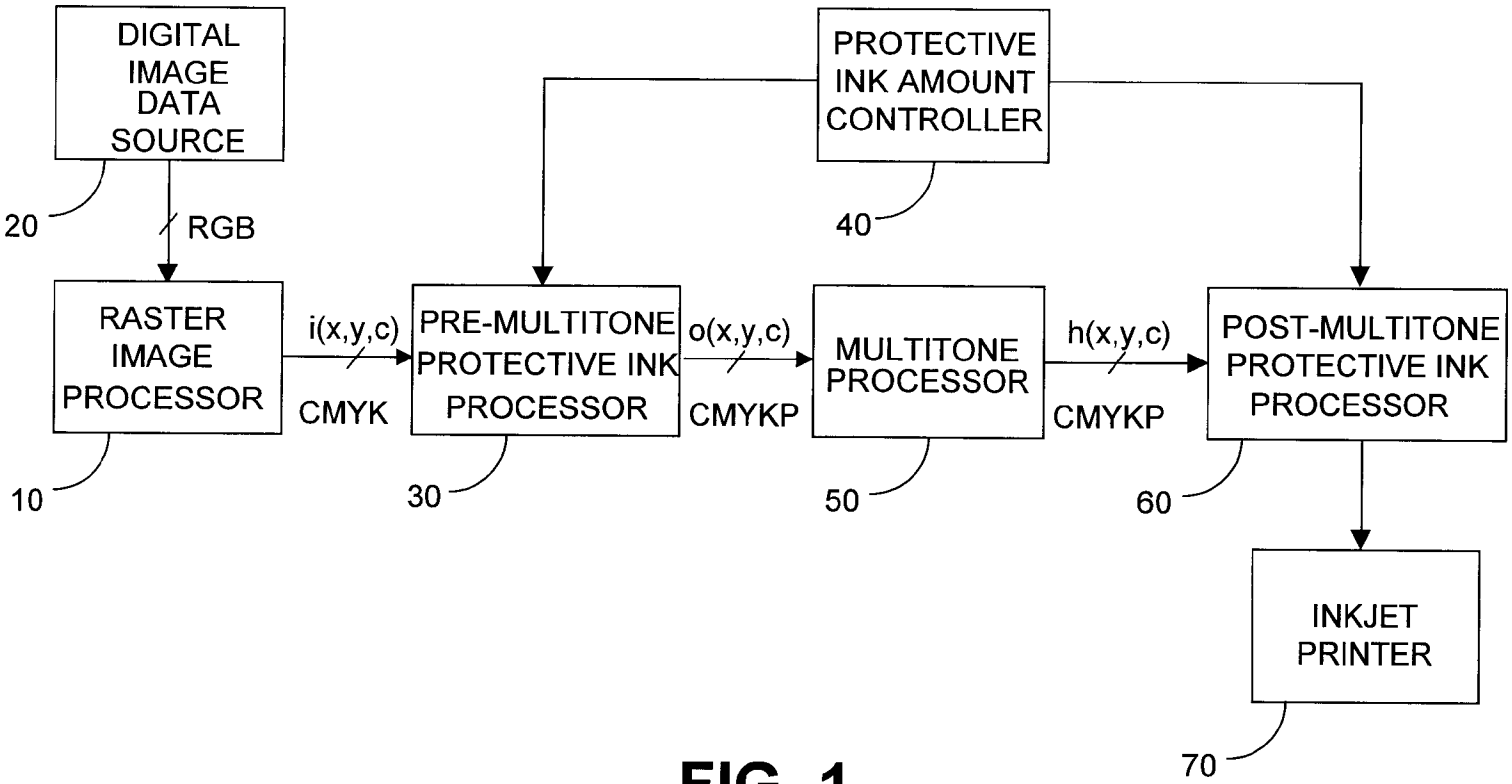
FIG. 1 is a flow diagram showing placement of the pre-multitone protective ink processor and post-multitone protective ink processor in an inkjet printer or printer driver.

Referring to FIG. 1, a generic image processing algorithm chain is shown for an inkjet printer in which a raster image processor 10 receives digital image data in the form of an input image from a digital image data source 20, which can be a host computer, network, computer memory, or other digital image storage device. The raster image processor 10 applies imaging algorithms to produce a processed digital image signal having input code values i(x,y,c), where x,y are the spatial coordinates of the pixel location, and c is the color channel coordinate. In one embodiment of the present invention, c has values 0, 1, 2, or 3 corresponding to C, M, Y, K, color channels, respectively. The types of imaging algorithms applied in the raster image processor 10 typically include sharpening (sometimes called "unsharp masking" or "edge enhancement"), color conversion (converts from the source image color space, typically RGB, to the CMYK color space of the printer), resizing (or spatial interpolation), and others. The imaging algorithms that are applied in the raster image processor 10 can vary depending on the application, and are not fundamental to the present invention. In a preferred embodiment of the present invention, the color conversion step implemented in the raster image processor 10 includes a multidimensional color transform in the form of an ICC profile as defined by the International Color Consortium's "File Format for Color Profiles," Specification ICC.1:2001-12. The ICC profile specifies the conversion from the source image color space (typically RGB) to an intermediate color space called the profile connection space (or PCS, in the terminology of the ICC specification). This conversion is then followed by a conversion from PCS to CMYK.

Following the raster image processor 10 of FIG. 1 is a pre-multitone protective ink processor 30, which receives the input code values i(x,y,c) and control parameters from a protective ink amount controller 40, and produces a modified image signal having output code values o(x,y,c) which includes an additional colorant channel corresponding to a protective ink. The protective ink is simply treated as an additional colorant channel, and is processed through the rest of the image chain (including multitoning) along with the other color channels.

Continuing with the image chain of FIG. 1, the pre-multitone protective ink processor 30 is followed by a multitone processor 50, which receives the output code value o(x,y,c) and produces a multitoned image signal h(x,y,c). The multitone processor 50 performs the function of reducing the number of bits used to represent each image pixel to match the number of printing levels available in the printer. Typically, the output code value o(x,y,c) will have 8 bits per pixel (per color), and the multitone processor 50 generally reduces this to 1 to 3 bits per pixel (per color) depending on the number of available printing levels. The multitone processor 50 can use a variety of different methods known to those skilled in the art to perform the multitoning. Such methods typically include error diffusion, clustered-dot dithering, or stochastic (blue noise) dithering. The particular multitoning method used in the multitone processor 50 is not fundamental to the present invention, but it is required that the pre-multitone protective ink processor 30 is implemented prior to the multitone processor 50 in the imaging chain. Following the multitone processor 50 is a post-multitone protective ink processor 60, which receives control parameters from the protective ink amount controller 40, and processes the multitoned image signal h(x,y,c) to produce a modified multitoned signal, which is sent to an inkjet printer 70 that deposits ink on the page accordingly to produce the desired image. The implementation of the pre-multitone protective ink processor 30 and the post-multitone protective ink processor 60 are the main subject of the present invention, and will be described hereinafter.

Figure 2:
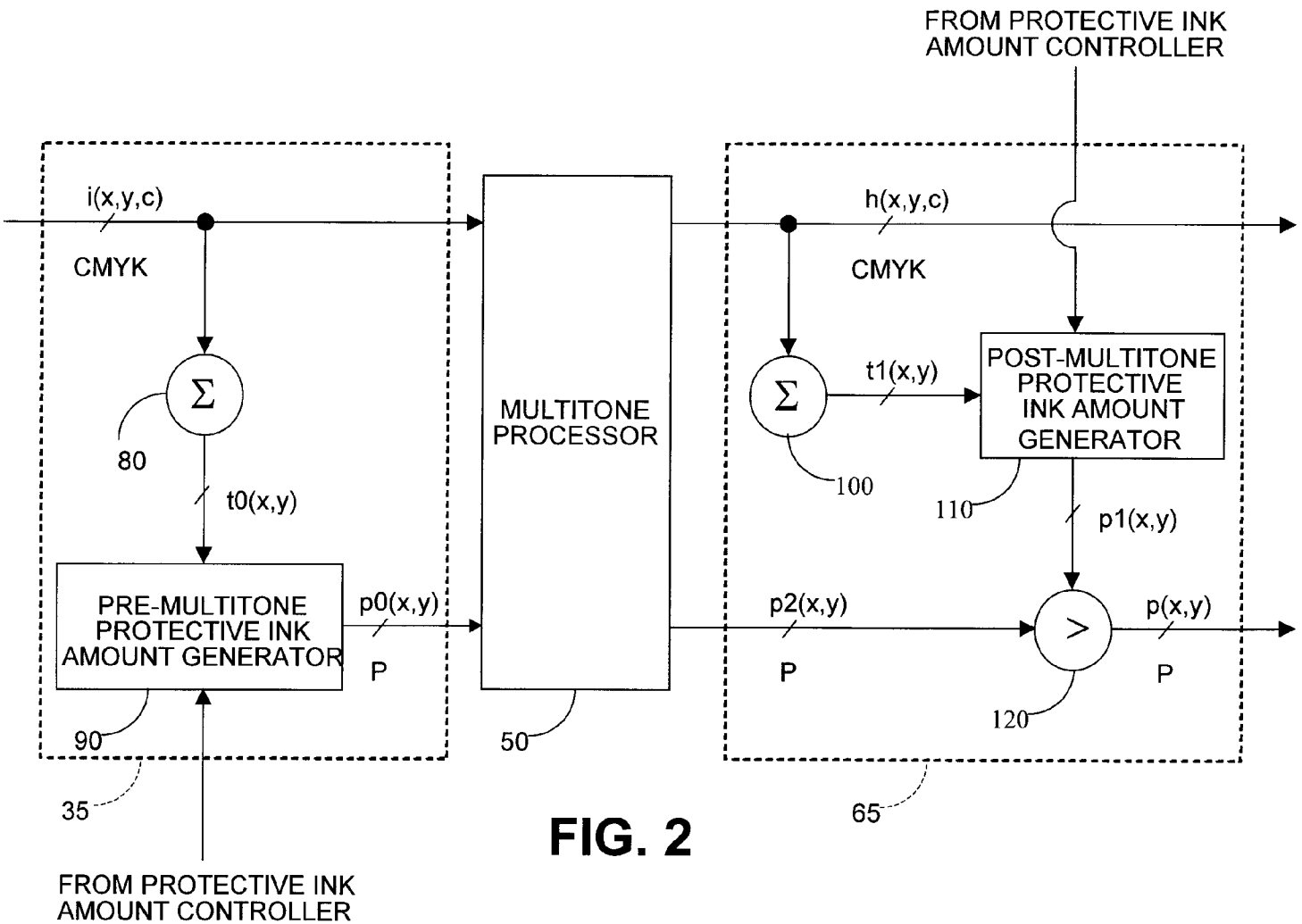
FIG. 2 is a flow diagram showing details of a preferred embodiment of the pre-multitone protective ink processor and post-multitone protective ink processor.

The fundamental aspects of the invention pertain to the pre-multitone protective ink processor 30 and post-multitone protective ink processor 60 of FIG. 1, as will now be described. Turning now to FIG. 2, the internal processing of the pre-multitone protective ink processor 30 of FIG. 1 according to a preferred embodiment of the present invention is shown inside a dashed box 35. The incoming CMYK code values for a given pixel, shown as signal i(x,y,c), which are typically 8 bit integer values on the range {0,255} representing the amount of each ink, are coupled to an adder 80 which sums the code values producing a colored ink amount sum, t0(x,y). The colored ink amount sum is then input to a pre-multitone protective ink amount generator 90, which outputs the desired amount of protective ink to be applied at pixel location (x,y) as signal p0(x,y). In a preferred embodiment of the present invention, the pre-multitone protective ink amount generator 90 is implemented using a look-up table which is indexed by the colored ink amount sum t0, and outputs the corresponding protective ink amount p0, stored as an integer value on the same range {0,255} as the CMYK input values. One skilled in the art will realize that the specific data range used here is not fundamental to the invention, and that the invention applies equally well to data spanning a different range. Other forms of the pre-multitone protective ink amount generator 90 are possible within the scope of the invention. For example, the protective ink amount can be computed based on formulas or equations stored in computer memory. Herein below, the pre-multitone protective ink amount generator 90 will be discussed in the look-up table form of the preferred embodiment. In the processing of FIG. 2, the CMYK input values are simply passed unmodified through the pre-multitone protective ink processor (dashed box 35) to the input of the multitone processor 50. The protective ink amount p0 is also passed along to the multitone processor 50, and is shown as a separate signal from the CMYK data for clarity. The outputs of the multitone processor 50 are a multitoned image signal h(x,y,c) corresponding to the CMYK color channels, and a multitoned protective ink signal p2(x,y) corresponding to the protective ink channel, P. These signals are input the post-multitone protective ink processor 60 of FIG. 1, a preferred embodiment of which is shown as the processing inside dashed box 65 of FIG. 2. In a preferred embodiment of the post-multitone protective ink processor, the multitoned image signal h(x,y,c) is coupled to adder 100, which sums the multitoned colored ink amounts corresponding to the CMYK colorants at the current pixel, and produces a multitoned colored ink amount sum, t1 (x,y). A post-multitone protective ink amount generator 110 receives the multitoned colored ink amount sum t1, and outputs the desired amount of protective ink to be applied at pixel location (x,y) as signal p1 (x,y). In a preferred embodiment of the present invention, the post-multitone protective ink amount generator 110 is implemented using a look-up table which is indexed by the multitoned colored ink amount sum t1, and outputs the corresponding protective ink amount p1, stored as an integer value on the same range {0,255} as the CMYK input values. Then, a comparator 120 compares the protective ink amount p1 and the protective ink amount p2, and selects the larger of these two as the appropriate amount of protective ink p(x,y) to be applied at the current pixel.

The fact that there are both a pre-multitone and post-multitone protective ink processor is fundamental to the invention, and will be further discussed below. The primary function of the pre-multitone protective ink processor is to set the broad area coverage of protective ink that is desired. Based on the amount of colored inks being printed in an image region, the pre-multitone protective ink processor determines the appropriate amount of protective ink that is required to provide for satisfactory durability, and achieve the objects of the present invention. However, since the protective ink amount is being determined prior to multitoning, it is difficult to guarantee that the protective ink is being printed at exactly the optimal pixels. This is because the multitoning process will convert a continuous tone image into a smaller number of gray levels at each pixel, but prediction of exactly what output gray level will be printed at each pixel requires that the image actually be processed through the multitone processor. Thus, it is possible that in an image region where it is desired to fully cover the receiver with either colored ink or protective ink, there may be a small number of "white" pixels that receive no ink. These white pixels will result in pinpoint locations on the receiver that are not protected from the environment, and are therefore subject to the negative image quality artifacts related to environmental exposure described above. The function of the post-multitone protective ink processor is to ensure that these "white" pixels are "filled in" with protective ink, providing for complete protection against the environment.

Figure 3:
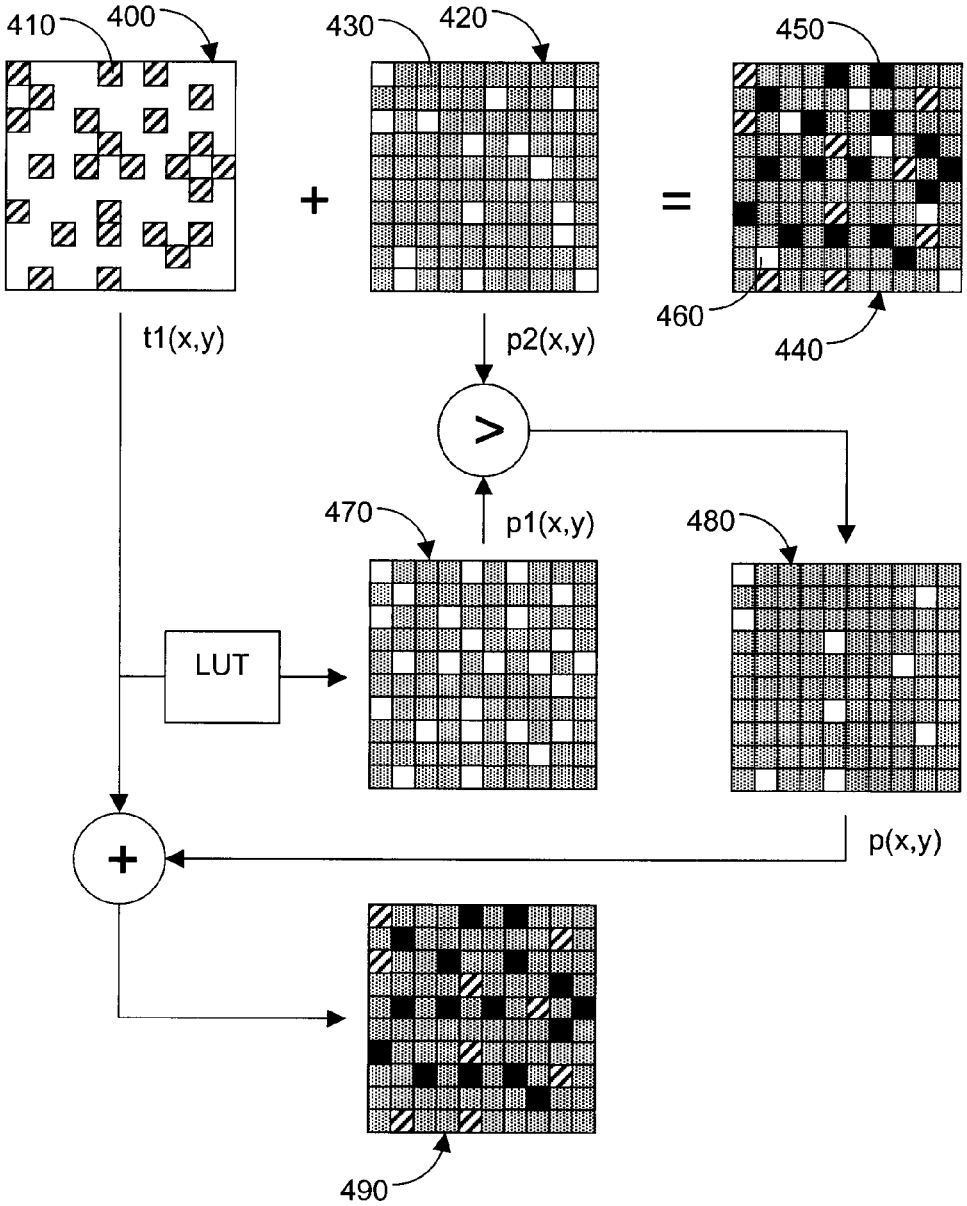
FIG. 3 is a diagram showing image regions computed according to the present invention.

Consider the following example, in which it is desired to protect a 10×10 pixel image region having uniform CMYK code values of {0,0,0,64}, respectively. This represents roughly a 25% coverage of K ink (since 64/255~0.25), and no CMY ink. For purposes of illustration, assume that the desired amount of protective ink (P) for this region is $^{217}/_{255}$, or about 85% coverage. In a preferred embodiment of the present invention, the desired protective ink amount determined by the pre-multitone protective ink processor is obtained using a look-up table indexed with the sum of the colored ink amounts, as described above, after which the continuous tone CMYKP data channels are then processed with the multitone processor 50 of FIG. 2. Referring to FIG. 3, the 10×10 pixel region of the K color channel generated by the multitone processor is shown as image region 400, which contains 25% K pixels 410 (having K ink), and 75% white pixels. It should be noted that this is just one possible pattern, and many other patterns are possible, depending on the particular form of the multitone processor. The precise pattern that results from the multitone process is not fundamental to the invention. Since the CMY channels are all zero, they are omitted from this example. The 10×10 pixel region of the P ink channel after multitoning is shown as image region 420, which contains 85% P pixels 430, (having P ink), and 15% white pixels. Overlapping these two image regions represents what would be observed on the printed page, and is shown as the image region 440, in which many pixels contain either K or P ink, but some pixels 450 contain both K and P ink, and some pixels 460 contain no ink. This occurs because the multitoning process implemented in the multitone processor 50 of FIG. 2 does not guarantee an inverse correlation between any two ink channels. In other words, the multitone processor 50 does not guarantee that the 85% desired P ink pixels will "fill in" the white pixels in image region 400. Thus, even though the desired amount of P ink is present in image region 440, it is not placed at the optimal pixels, and white pixels 460 remain, leaving a vulnerability for environmental factors to degrade the image. However, this vulnerability is corrected by the post-multitone protective ink processor, which examines the image region 400, and sums up the colored ink amounts at each pixel, as described in FIG. 2. Since the CMY ink channels are all zero in this example, the sum of the colored inks will match the image region 400. The post-multitone protective ink amount generator 110 then uses the sum to determine an alternative P ink amount for the pixel, represented by the signal p1 of FIG. 2, and shown graphically for the current example as image region 470 of FIG. 3. In a preferred embodiment of the present invention, the post-multitone protective ink amount generator would place protective ink on the page wherever it found white pixels in the sum of the colored ink channels, as shown in image region 470. Then the larger of the two candidate P ink values for each pixel is taken, and is represented by image region 480 of FIG. 3. Image region 480 represents the actual amount of P ink that would be printed together with the colored inks, resulting in image region 490, which is now devoid of white pixels, providing for maximum protection against environmental factors.

It should be noted that neither the pre-multitone protective ink processor nor the post-multitone protective ink processor alone are totally sufficient for providing complete protection. As shown in the example above, the pre-multitone protective ink processor delivers the desired amount of protective ink based on the amount of colored ink present in an image region, but alone cannot guarantee that the protective ink is placed at the optimal pixels. The post-multitone protective ink processor alone is capable of ensuring that there are no white pixels in the output, but cannot always deliver the desired amount of protective ink in regions that already have some inked pixels. This is because the post-multitone protective ink processor is incapable of distinguishing inked pixels in a sparse field from inked pixels in a full coverage field. The amount of protective ink that is desirable for optimal protection is different for these two types of image regions, an example of which is discussed below.

The shape of the protective ink amount look-up table implemented by the pre-multitone protective ink amount generator 90 of FIG. 2 controls the amount of protective ink that is applied in response to the sum of the colored ink amounts. In this way, a fine degree of control can be obtained by designing the shape of the look-up table to produce optimal image quality. Several variants of the protective ink amount look-up table designed to optimize different image quality aspects will now be described.

Figure 4:
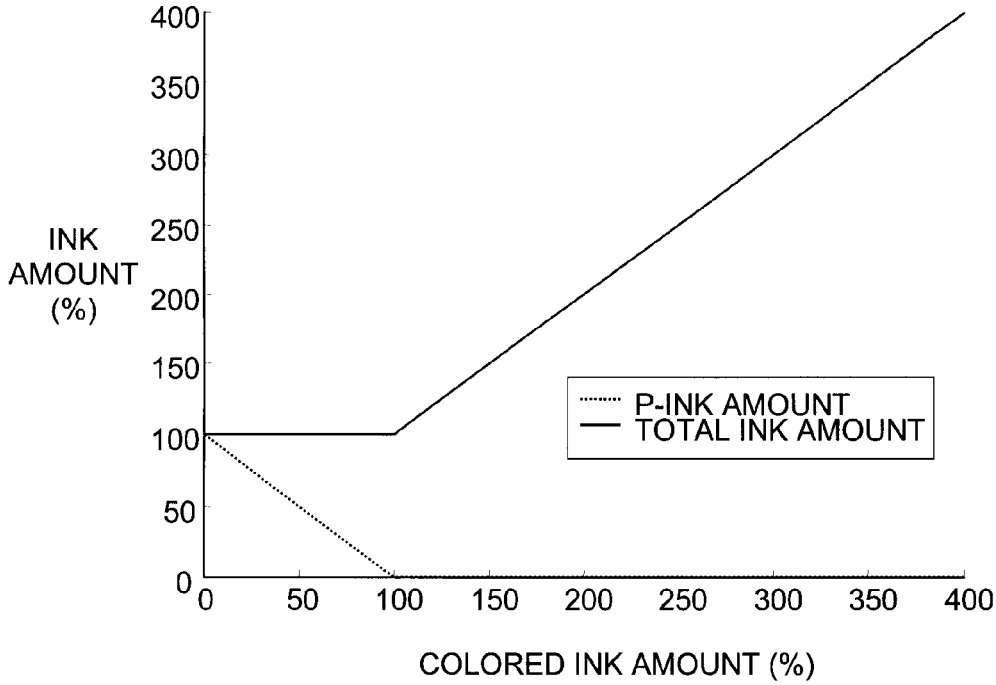
FIG. 4 is a graph showing the protective ink amount and total ink amount as a function of the total colored ink amount according to one embodiment of the present invention.

Turning to FIG. 4, a graph of one variant of the protective ink amount look-up table implemented by the pre-multitone protective ink amount generator 90 of FIG. 2 is shown. In this graph, the sum of the colored ink amounts is shown on the horizontal axis as a percent number. Thus, a value of 100% means that the maximum amount of one ink is placed at each pixel on the printed page (or 50% of two inks, etc). Similarly, a value of 200% indicates full coverage of two inks, and a value of 400% indicates full coverage of all four (CMYK) inks. As will be obvious to one skilled in the art, the invention will apply to printers using a different number of inks, or different colored inks. In these cases, the percent ink values simply scale to the number of inks used. For example, in a six ink printer using the standard CMYK inks plus light cyan (c) and light magenta (m), the sum of the colored ink amounts would vary between 0% and 600%. Still referring to FIG. 4, the desired percent protective ink amount (a.k.a. "P-ink") is shown plotted as a dotted line, and the total ink amount, which is the sum of the colored ink amounts and the protective ink amount, is shown plotted as a solid line. In light of these plots, consider a region of the print intended to be white (i.e., no colored ink is printed), which will have the sum of the colored ink amounts be 0. According to the look-up table of FIG. 4, the amount of protective ink applied in this white region will be 100%, indicating that full coverage of the protective ink will be printed by the printer. This completely seals the media from the environmental factors as described above, providing resistance to staining fluids, water, and smearing of ink from printed areas into white areas.

Another important aspect of the look-up table of FIG. 4 is that the amount of protective ink applied is controlled as a function of the sum of the colored inks such that the total ink amount is at least a minimum ink amount of 100%. This means that a 50% coverage region of the image will obtain an additional 50% coverage of protective ink, bringing the total to 100%. This is a significant deviation from the prior art, and is motivated by the fact that a minimum ink amount is required to achieve sufficient environmental protection. As described earlier, the use of pigmented inks will provide for some protection against the environment, as will the protective ink. As long as the total ink amount is at least the minimum ink amount (in this case 100%), satisfactory protection is achieved. The minimum ink amount required for satisfactory protection will vary depending on the chemistry of the inks and media used, and should be determined experimentally, as will be understood by one skilled in the art.

Figure 5:
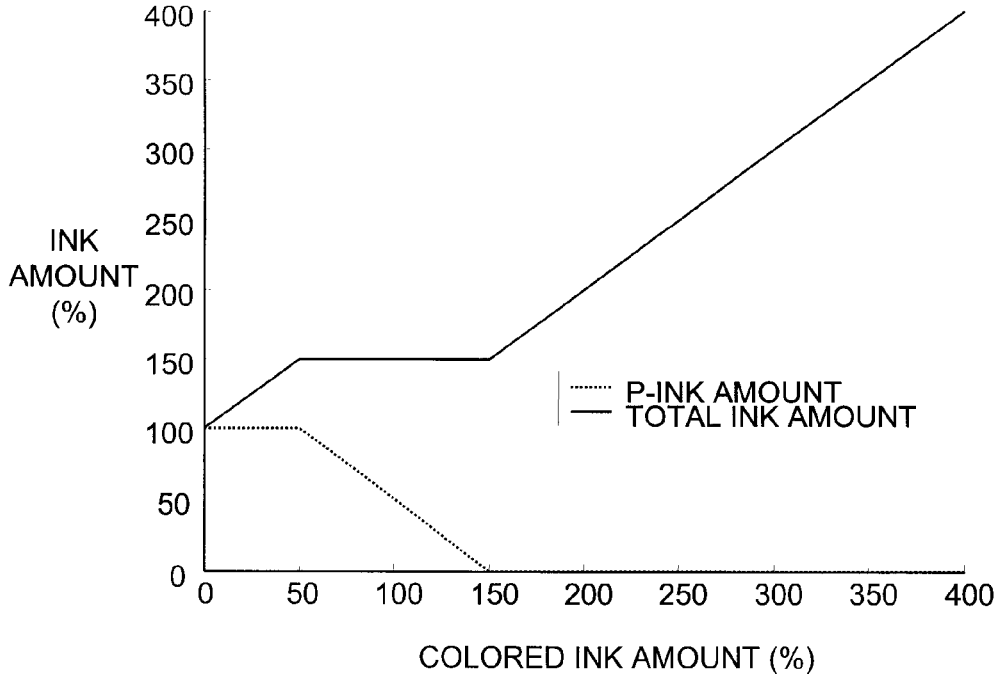
FIG. 5 is a graph showing the protective ink amount and total ink amount as a function of the total colored ink amount according to another embodiment of the present invention.

An example of another variant of the protective ink amount look-up table implemented by the pre-multitone protective ink amount generator 90 of FIG. 2 is shown in FIG. 5. In this look-up table, the total ink amount is constrained to be less than a threshold ink amount of 150% for regions where the sum of the colored ink amounts is less than 150%. This has the effect of providing for excellent protection by utilizing 100% coverage of protective ink for light density and white portions of the image (up to 50% coverage), and then reducing the amount of protective ink gradually to keep the total ink amount less than the threshold ink amount of 150% to conserve ink. Note that in this case, the total ink amount (and protective ink amount) vary discontinuously with the sum of the colored ink amounts, which is a deviation from the prior art.

Figure 6:
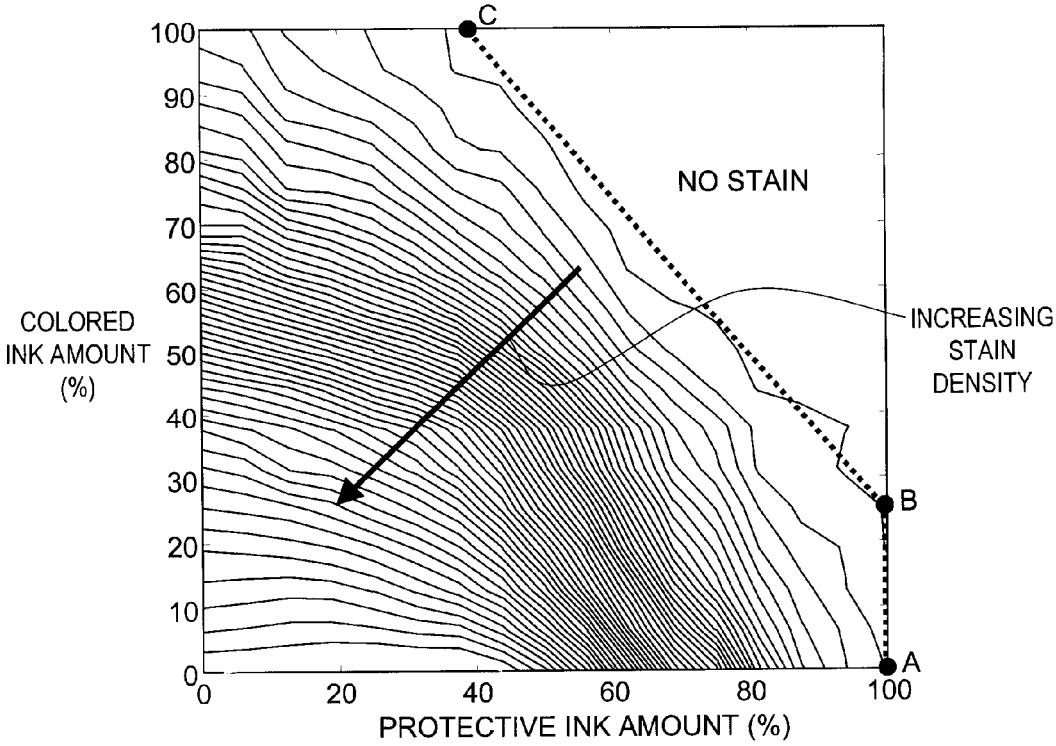
FIG. 6 is a graph showing stain density contours for various overprints of protective ink and colored ink.
Figure 7:
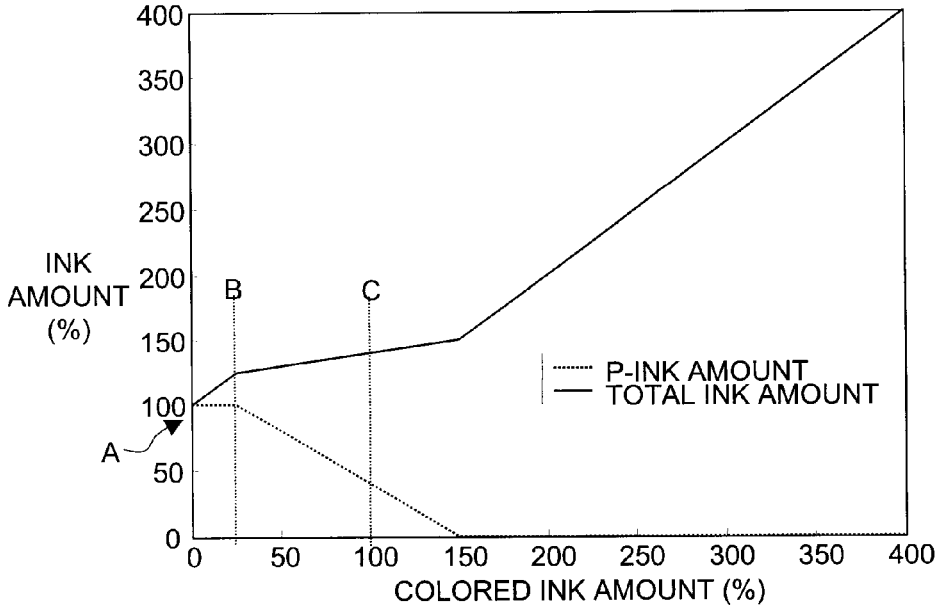
FIG. 7 is a graph showing the protective ink amount and total ink amount as a function of the total colored ink amount according to another embodiment of the present invention.

Even more complicated variants of the protective ink look-up table of FIG. 2 can be produced advantageously to provide for optimal environmental protection while minimizing the amount of protective ink required. Consider an experiment in which a square image is printed where the amount of protective ink increases from 0% to 100% horizontally, and the amount of colored ink (assume one ink, such as yellow) increases from 0% to 100% vertically. Thus, the lower left corner of the image has no ink printed, the upper right corner has 200% ink printed (=100% Y+100% protective ink), the upper left corner has 100% Y ink only, and the lower right corner has 100% protective ink only. The ink amounts interior to the square are linearly interpolated from the four corners. The density values are measured at a grid of locations throughout the image, and then the printed image is immersed in a liquid staining agent and mildly agitated for 30 seconds, after which it is removed, rinsed off, and dried. The density values are again measured at the same grid of locations throughout the image. The difference between the "unstained" and "stained" density values indicates the stain density, or the amount of staining that was present. A low value for the stain density indicates that little or no stain was measured. A high value for the stain density indicates the opposite. A contour plot of the stain density that was measured for the above experiment is shown in FIG. 6. As expected, the upper right portion of the image had no staining, since this region was protected by high percentages of both the Y and protective inks. Moving towards the lower left, the stain density increases, indicating poorer levels of protection. Each of the contour lines in the plot of FIG. 6 indicates a constant stain density level. As can be seen from FIG. 6, the optimal amount of protective ink to apply for colored ink amounts between 0% and 100% is indicated by a path between the points labeled A, B, and C. This path provides for minimal staining and minimal protective ink usage. In actuality, for the particular protective ink used in this experiment, slightly more than 100% of protective ink would be required to produce absolutely no staining on white paper (as indicated by the small amount of stain density present at point A), but this would require an extra print pass over the same location on the page to apply, and would increase the print time undesirably. Also note that 100% coverage of Y ink was insufficient to provide complete stain protection, and an additional 40% or more of protective ink was required to achieve optimal performance. The data from the optimal path of FIG. 6 is plotted as a look-up table in FIG. 7, where the points labeled A, B, and C correspond between the two figures. Note in this case that the optimal protective ink amount is extrapolated beyond point C in FIG. 7, corresponding to sum of colored ink amounts greater than 100%. In a preferred embodiment, an additional set of experiments would be conducted to print and measure stain densities for higher ink laydowns to determine the optimal protective ink amount in this region. Also note that the total ink amount shown in FIG. 7 has an unusual and nonobvious shape, which results from the staining experiment described above.

Figure 8:
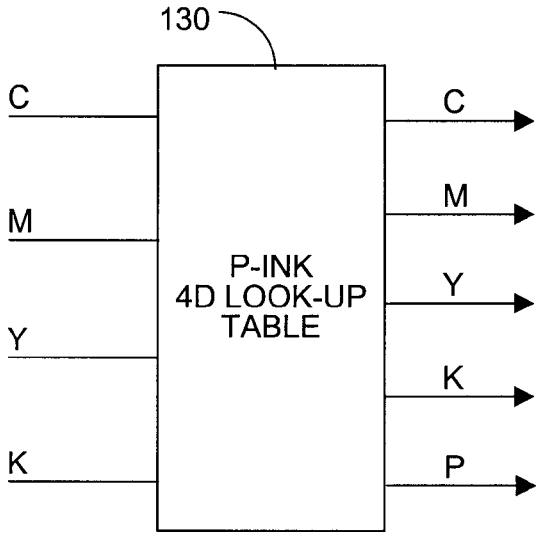
FIG. 8 is a flow diagram showing an embodiment of the pre-multitone protective ink processor implemented as a multidimensional look-up table.

It is common for the different colored inks in an inkjet printer to be formulated from very different chemical agents. Therefore, the protective properties of each ink can be different. This means that to achieve optimal protection while minimizing the protective ink, a different amount of protective ink may be required depending on which inks are being printed along with it. To provide for this case, another embodiment of the present invention will now be described. Turning to FIG. 8, another implementation of the pre-multitone protective ink processor 30 of FIG. 1 is shown. A multidimensional look-up table 130 is addressed with the colored ink amounts (CMYK code values), and outputs CMYKP code values, where P indicates the protective ink channel value. One skilled in the art will recognize that the multidimensional look-up table 130 permits a more sophisticated protective ink function to be implemented, including providing for varying amounts of protective ink depending on which ink colors are being printed at the current pixel. A preferred embodiment of the present invention would still have the CMYK code values that are output from the multidimensional look-up table 130 match the CMYK input values, although this is not necessarily the case.

Figure 10:
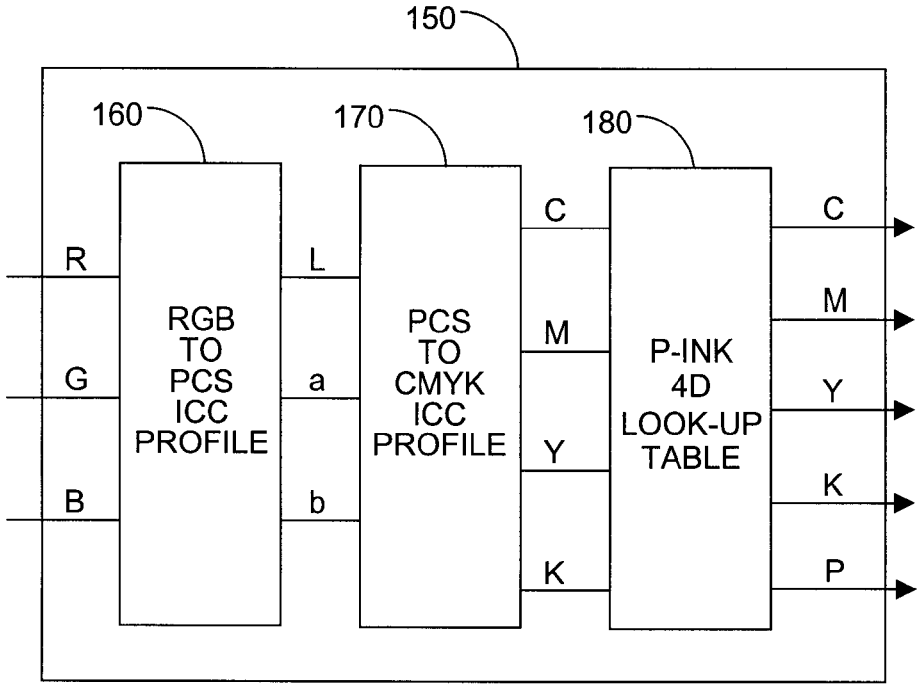
FIG. 10 is flow diagram showing composed look-up table which implements color management look-up tables and the pre-multitone protective ink multidimensional look-up table.
Figure 9:
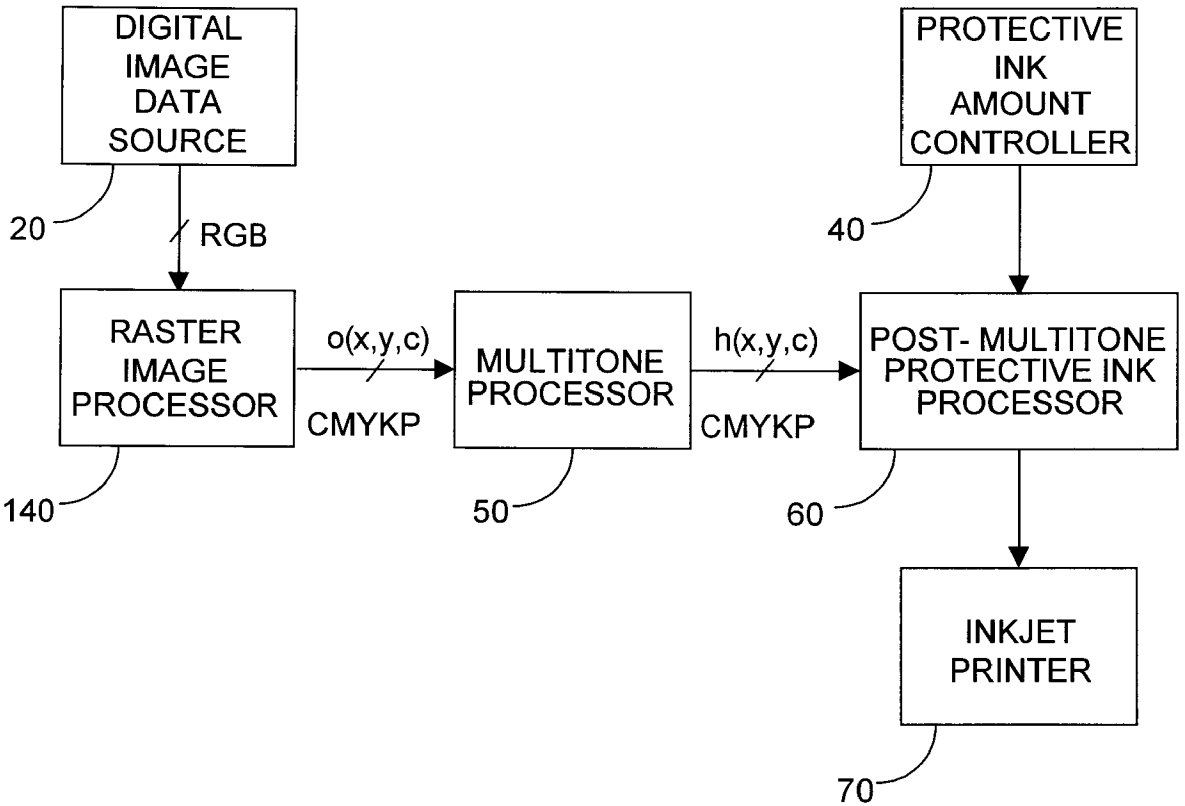
FIG. 9 is a flow diagram showing a raster image processor which implements a pre-multitone protective ink processor as part of an inkjet printer or printer driver.

Those skilled in the art will also recognize that the multidimensional look-up table implementation shown in FIG. 8 is a more general form of the one dimensional look-up table implementation described earlier. That is, the one dimensional look-up table behavior can also be implemented using an implementation as shown in FIG. 8. This provides for an additional advantage, as will now be discussed. Consider the inkjet printer image chain as shown in FIG. 9, in which the raster image processor 140 directly outputs CMYKP data, which includes the protective ink amount, as indicated by the "P". The advantage of this image chain comes in terms of computational efficiency. Recall that the raster image processor 140 typically contains at least one multidimensional color transform in the form of an ICC profile, as described above. A gain in computational efficiency can be achieved by composing several multidimensional look-up tables together, as opposed to applying each multidimensional look-up table separately. FIG. 10 shows a composed look-up table 150, which is the combination of several multidimensional look-up tables. Multidimensional look-up table 160 provides the color transformation between the input color space, shown here as RGB, to PCS. The PCS used here is the CIE L*a*b* space, which has a luminance signal L*, and two chromatic signals a* and b*. Multidimensional look-up table 170 then converts the PCS data to CMYK. Then, the multidimensional look-up table 180 performs the protective ink processing, and outputs CMYKP. By combining these three tables into a single table, which takes RGB inputs and directly outputs CMYKP, a significant savings in processing time can be realized. As shown in FIG. 9, the processing efficiency of the composed multidimensional look-up table implementation of the pre-multitone protective ink processor (contained within raster image processor 140) is combined with the white pixel prevention properties of the post-multitone protective ink processor to simultaneously provide processing efficiency and optimal durability protection.

After the optimal colored ink and protective ink amounts are computed as described above, the data is sent along to inkjet printer 70 of FIG. 1. The inkjet printer 70 deposits ink on the page at each pixel location according to the multi-toned CMYKP code values to produce the desired image. All of the pixels in the input digital image are sequentially processed through the image chain of FIG. 1, and sent to the inkjet printer 70, which typically prints the pixels in a raster scanned fashion.

A computer program product can include one or more storage medium, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

The invention has been described in detail with particular reference to certain preferred embodiments thereof, but it will be understood that variations and modifications can be effected within the spirit and scope of the invention. In particular, the present invention has been described in the context of an inkjet printer which prints with CMYK colorants, but in theory the invention should apply to other types of printing technologies also, as well as inkjet printers using different color inks other than CMYK.

The present invention can also be equally well applied to printers having multiple output levels, such as an inkjet printer that can produce multiple drop sizes. Since the preferred embodiment of the post-multitone protective ink amount generator 110 of FIG. 2 utilizes a look-up table indexed by the sum of the multitoned colored ink amounts, then an appropriate amount of protective ink can be applied for each of the drop sizes to provide for optimal durability protection while minimizing the amount of protective ink required.

PARTS LIST

10 raster image processor
20 digital image data source
30 pre-multitone protective ink processor
35 dashed box
40 protective ink amount controller
50 multitone processor
60 post-multitone protective ink processor
65 dashed box
70 inkjet printer
80 adder
90 pre-multitone protective ink amount generator
100 adder
110 post-multitone protective ink amount generator
120 comparator
130 multidimensional look-up table
140 raster image processor
150 composed look-up table
160 multidimensional look-up table
170 multidimensional look-up table
180 multidimensional look-up table
400 image region
410 K pixels
420 image region
430 P pixels
440 image region
450 K+P pixels
460 white pixels
470 image region
480 image region
490 image region

The invention claimed is:

1. A method of determining and applying a protective ink amount to be printed in addition to a plurality of colored ink amounts to make colored pixels in an image wherein different colored pixels have different colored ink amounts, comprising:

a) determining a first protective ink amount for each pixel which varies in accordance with the colored ink amount of each pixel;

b) determining multitoned colored ink amounts for each pixel using a multitone processor responsive to the amount of each of the colored ink;

c) determining a second protective ink amount for each pixel responsive to the multitoned colored ink amounts;

d) determining the protective ink amount for each pixel responsive to the first protective ink amount and the second protective ink amount to provide adequate durability for the pixel; and e) using an inkjet printer to apply the multitoned colored ink amounts and the protective ink amount to make the colored image pixels.

2. The method according to claim 1 wherein step a) further includes:

i) determining a first total colored ink amount as a sum of the colored ink amounts, and ii) determining the first protective ink amount responsive to the first total colored ink amount.

3. The method according to claim 2 wherein the first protective ink amount is determined such that a sum of the first protective ink amount and the first total colored ink amount is greater than or equal to a minimum ink amount for all pixels.

4. The method according to claim 3 wherein the minimum ink amount at each pixel is equal to 100% ink coverage.

5. The method according to claim 2 wherein step ii) further includes determining the first protective ink amount using a look-up table addressed with the first total colored ink amount.

6. The method according to claim 1 wherein the first protective ink amount is determined using a multidimensional look-up table addressed with the colored ink amounts.

7. The method according to claim 1 wherein step c) further includes:

i) determining a second total colored ink amount as a sum of the multitoned colored ink amounts; and ii) determining the second protective ink amount responsive to the second total colored ink amount.

8. The method according to claim 7 wherein the second protective ink amount is determined such that a sum of the second protective ink amount and the second total colored ink amount is greater than or equal to a minimum ink amount for all pixels.

9. The method according to claim 7 wherein step ii) further includes determining the second protective ink amount using a look-up table addressed with the second total colored ink amount.

10. The method according to claim 1 wherein the second protective ink amount is determined using a multidimensional look-up table addressed with the multitoned colored ink amounts.

11. The method according to claim 1 wherein the protective ink amount is determined as the larger of the first protective ink amount and the second protective ink amount.

12. A computer program product having instructions stored thereon for causing a computer to perform the method according to claim 1.

* * * * *